US010019877B2

(12) United States Patent
Dvir et al.

(10) Patent No.: US 10,019,877 B2
(45) Date of Patent: Jul. 10, 2018

(54) APPARATUS AND METHODS FOR THE SEMI-AUTOMATIC TRACKING AND EXAMINING OF AN OBJECT OR AN EVENT IN A MONITORED SITE

(75) Inventors: Igal Dvir, Ra'anana (IL); Moti Shabtal, Rosh Ha'aylin (IL)

(73) Assignee: Qognify Ltd., Ra'anana (IL)

( * ) Notice: Subject to any disclaimer, the term of this patent is extended or adjusted under 35 U.S.C. 154(b) by 2126 days.

(21) Appl. No.: 10/536,555

(22) PCT Filed: Apr. 3, 2005

(86) PCT No.: PCT/IL2005/000368

§ 371 (c)(1),
(2), (4) Date: Jun. 5, 2008

(87) PCT Pub. No.: WO2006/106496

PCT Pub. Date: Oct. 12, 2006

(65) Prior Publication Data

US 2010/0157049 A1 Jun. 24, 2010

(51) Int. Cl.
*G08B 13/196* (2006.01)

(52) U.S. Cl.
CPC . *G08B 13/19676* (2013.01); *G08B 13/19608* (2013.01); *G08B 13/19641* (2013.01); *G08B 13/19671* (2013.01); *G08B 13/19673* (2013.01); *G08B 13/19682* (2013.01); *G08B 13/19693* (2013.01)

(58) Field of Classification Search
CPC ..... H04N 7/181; H04N 7/183; H04N 7/18
USPC ..... 348/143, 159, 169
See application file for complete search history.

(56) References Cited

U.S. PATENT DOCUMENTS 4,145,715 A 3/1979 Clever
4,527,151 A 7/1985 Byrne
4,821,118 A 4/1989 Lafreniere
(Continued)

FOREIGN PATENT DOCUMENTS

DE 10358333 7/2005
EP 749098 12/1996
(Continued)

OTHER PUBLICATIONS

Freedman, I. Closing the Contact Center Quality Loop with Customer Experience Management, Customer Interaction Solutions, vol. 19, No. 9, Mar. 2001.

(Continued)

*Primary Examiner* — Chikaodili E Anyikire
(74) *Attorney, Agent, or Firm* — Pearl Cohen Zedek Latzer Baratz LLP

(57) ABSTRACT

A method and apparatus for the investigation of an object or an event in a video clip, by playing video clips of the object or objects associated with the events. The video frames comprised within the video clips comprise information regarding the creation time and coordinates of the objects appearing in multiple frames, thus enabling an operator to immediately play video clips tracking the object starting at the object's creation time within the field of view, until its disappearance from the field of view. By defining neighboring regions, and keeping the creation time of each object within each video stream, an object is tracked between different fields of view.

19 Claims, 5 Drawing Sheets

(56) References Cited

U.S. PATENT DOCUMENTS

| | | | | |
|---|---|---|---|---|
| 5,034,986 | A | 7/1991 | Karmann et al. | |
| 5,051,827 | A | 9/1991 | Fairhurst | |
| 5,091,780 | A | 2/1992 | Pomerleau | |
| 5,097,327 | A | 3/1992 | Hasebe | |
| 5,303,045 | A | 4/1994 | Richards et al. | |
| 5,307,170 | A | 4/1994 | Itsumi et al. | |
| 5,353,168 | A | 10/1994 | Crick | |
| 5,404,170 | A | 4/1995 | Keating | |
| 5,491,511 | A | 2/1996 | Odle | |
| 5,519,446 | A | 5/1996 | Lee | |
| 5,734,441 | A | 3/1998 | Kondo et al. | |
| 5,742,349 | A | 4/1998 | Choi et al. | |
| 5,748,775 | A | 5/1998 | Tsuchikawa et al. | |
| 5,751,346 | A | 5/1998 | Dozier et al. | |
| 5,790,096 | A | 8/1998 | Hill, Jr. | |
| 5,796,439 | A | 8/1998 | Hewett et al. | |
| 5,847,755 | A | 12/1998 | Wixson et al. | |
| 5,895,453 | A | 4/1999 | Cook et al. | |
| 5,920,338 | A | 7/1999 | Katz | |
| 6,014,647 | A | 1/2000 | Nizzari et al. | |
| 6,028,626 | A | 2/2000 | Aviv et al. | |
| 6,031,573 | A | 2/2000 | MacCormack et al. | |
| 6,037,991 | A | 3/2000 | Thro et al. | |
| 6,070,142 | A | 5/2000 | McDonough et al. | |
| 6,081,606 | A | 6/2000 | Hansen et al. | |
| 6,092,197 | A | 7/2000 | Coueignoux | |
| 6,094,227 | A | 7/2000 | Guimier | |
| 6,097,429 | A | 8/2000 | Seeley et al. | |
| 6,111,610 | A | 8/2000 | Faroudja | |
| 6,134,530 | A | 10/2000 | Bunting et al. | |
| 6,138,139 | A | 10/2000 | Beck et al. | |
| 6,167,395 | A | 12/2000 | Beck et al. | |
| 6,170,011 | B1 | 1/2001 | Macleod Beck et al. | |
| 6,212,178 | B1 | 4/2001 | Beck | |
| 6,230,197 | B1 | 5/2001 | Beck et al. | |
| 6,295,367 | B1 | 9/2001 | Crabtree et al. | |
| 6,327,343 | B1 | 12/2001 | Epstein et al. | |
| 6,330,025 | B1 | 12/2001 | Arazi | |
| 6,345,305 | B1 | 2/2002 | Beck et al. | |
| 6,359,647 | B1* | 3/2002 | Sengupta | G08B 13/19608 348/143 |
| 6,404,857 | B1 | 6/2002 | Blair et al. | |
| 6,427,137 | B2 | 7/2002 | Petrushin | |
| 6,441,734 | B1 | 8/2002 | Gutta et al. | |
| 6,476,858 | B1* | 11/2002 | Ramirez Diaz et al. | 348/159 |
| 6,531,066 | B1 | 3/2003 | Saunders et al. | 210/787 |
| 6,549,613 | B1 | 4/2003 | Dikmen | |
| 6,559,769 | B2 | 5/2003 | Anthony et al. | |
| 6,570,608 | B1 | 5/2003 | Tserng | |
| 6,604,108 | B1 | 8/2003 | Nitahara | |
| 6,628,835 | B1 | 9/2003 | Brill et al. | |
| 6,704,409 | B1 | 3/2004 | Dilip et al. | |
| 6,987,528 | B1 | 1/2006 | Nagahisa et al. | |
| 7,076,427 | B2 | 7/2006 | Scarano et al. | |
| 7,103,806 | B1 | 9/2006 | Horvitz | |
| 7,436,887 | B2 | 10/2008 | Yeredor et al. | |
| 2001/0043697 | A1 | 11/2001 | Cox et al. | |
| 2001/0052081 | A1 | 12/2001 | McKibben et al. | |
| 2002/0005898 | A1 | 1/2002 | Kawada et al. | |
| 2002/0010705 | A1 | 1/2002 | Park et al. | |
| 2002/0030739 | A1* | 3/2002 | Nagaya et al. | 348/143 |
| 2002/0059283 | A1 | 5/2002 | Shapiro et al. | |
| 2002/0087385 | A1 | 7/2002 | Vincent | |
| 2002/0163577 | A1* | 11/2002 | Myers | 348/152 |
| 2003/0033145 | A1 | 2/2003 | Petrushin | |
| 2003/0059016 | A1 | 3/2003 | Lieberman et al. | |
| 2003/0085992 | A1* | 5/2003 | Arpa | G06T 15/205 348/47 |
| 2003/0128099 | A1 | 7/2003 | Cockerham | |
| 2003/0163360 | A1 | 8/2003 | Galvin | |
| 2003/0179294 | A1* | 9/2003 | Martins | G01S 3/781 348/157 |
| 2003/0210329 | A1* | 11/2003 | Aagaard | H04N 7/181 348/159 |
| 2004/0098295 | A1 | 5/2004 | Sarlay et al. | |
| 2004/0141508 | A1 | 7/2004 | Schoeneberger et al. | |
| 2004/0161133 | A1* | 8/2004 | Elazar | G01S 3/7864 382/115 |
| 2004/0249650 | A1 | 12/2004 | Freedman et al. | |
| 2005/0046699 | A1 | 3/2005 | Oya et al. | |
| 2006/0093135 | A1 | 5/2006 | Fiatal et al. | |
| 2010/0157049 | A1* | 6/2010 | Dvir | G08B 13/19608 348/143 |

FOREIGN PATENT DOCUMENTS

| | | | |
|---|---|---|---|
| EP | 0885585 | A1 | 6/1997 |
| EP | 1 484 892 | | 8/2004 |
| FR | 2812183 | A1 | 11/2000 |
| GB | 9916430.3 | | 7/1999 |
| IL | 03 067884 | A1 | 8/2003 |
| WO | 95 29470 | A | 11/1995 |
| WO | 98 01838 | A | 1/1998 |
| WO | WO 00/73996 | | 12/2000 |
| WO | WO 00/74548 | | 12/2000 |
| WO | WO-2001/028251 | | 4/2001 |
| WO | WO-2001/045415 | | 6/2001 |
| WO | WO 02/37856 | | 5/2002 |
| WO | 03 013113 | A2 | 2/2003 |
| WO | 03/067360 | A2 | 8/2003 |
| WO | WO 03 067884 | A1 | 8/2003 |
| WO | WO-2003/067360 | | 8/2003 |
| WO | WO-2003/067884 | | 8/2003 |
| WO | WO-2003/100726 | | 12/2003 |
| WO | WO 04 091250 | | 10/2004 |

OTHER PUBLICATIONS

PR Newswire, NICE Redefines Customer Interactions with Launch of Customer Experience Management, Jun. 13, 2000.

PR Newswire, Recognition Systems and Hyperion to Provide Closed Loop CRM Analytic Applications, Nov. 17, 1999.

Financial companies want to turn regulatory burden into competitive advantage, Feb. 24, 2003, printed from InformationWeek, http://www.informationweek.com/story/IWK20030223S0002.

(Hebrew) print from Haaretz, "The Computer at the Other End of the Line", Feb. 17, 2002.

Article Sertainty—Agent Performance Optimization—2005 SE Solutions, Inc.

Lawrence P. Mark SER—White Paper—Sertainty Quality Assurance—2003-2005 SER Solutions Inc.

Douglas A. Reynolds Robust Text Independent Speaker Identification Using Gaussian Mixture Speaker Models—IEEE Transactions on Speech and Audio Processing, vol. 3, No. 1, Jan. 1995.

Chaudhari, Navratil, Ramaswamy, and Maes Very Large Population Text-Independent Speaker Identification Using Transformation Enhanced Multi-Grained Models—Upendra V. Chaudhari, Jiri Navratil, Ganesh N. Ramaswamy, and Stephane H. Maes—IBM T.j. Watson Research Centre—Oct. 2000.

Douglas A. Reynolds, Thomas F. Quatieri, Robert B. Dunn Speaker Verification Using Adapted Gaussian Mixture Models—Oct. 1, 2000.

Frederic Bimbot et al—A Tutorial on Text-Independent Speaker Verification EURASIP Journal on Applied Signal Processing 2004:4, 430-451.

EP Search Report dated Apr. 13, 2007.

Lawrence P. Mark , "White Paper, Sertainty, Automated Quality Monitoring", SER Solutions, Inc.—21680 Ridgetop Circle Dulles, VA—WWW.ser.com, Apr. 19, 2004, pp. 1-17.

D. A. Reynolds et al. "Robust text-independent speaker identification using Gaussian mixture speaker models", IEEE Transaction on Speech and Audio Processing. vol. 3, No. 1, Jan. 1995. pp. 72-83.

Zigel et al. "How to Deal with Multiple-Targets in Speaker Identification Systems?", 2006 IEEE Odyssey—The Speaker and Language Recognition Workshop, Jun. 28-30, 2006, pp. 1-7.

Y. K. Muthusamy et al. , "Automatic language identification: A Review/Tutorial", IEEE Signal Processing Magazine, Oct. 1994, vol. 11, No. 4, pp. 33-41.

(56) References Cited

OTHER PUBLICATIONS

M. A. Zissman, "Comparison of four approaches to automatic language identification of telephone speech", IEEE Transactions on Speech and Audio Processing, Jan. 1996, vol. 4, No. 1, pp. 31-44.
N. Amir, S. Ron, "Toward an Automatic Classification of Emotions in Speech", Proceedings of the 4th Int. Conf. on Spoken Language Processing, Sydney, Australia, Nov. 30-Dec. 4, 1998.
International Search Report of PCT Application No. PCT/IL05/00368 dated Nov. 17, 2005.
Dallmeier Electronic, "SEDOR-self-learning event detector Intelligent monitoring using self-learning event detection", retreived from: http://www.dallmeier-electronic.com on Mar. 2005.
Unknown author, "Nice Systems Announces New Aviation Security Initiative", Airport Security focus, Security Technology & Design, Dec. 2001, p. 1.
Agozy, "The Camera that Never Sleeps", Yediot Aharonot, Nov. 10, 2002 (Hebrew).
Nice Systems Ltd., "Secure your Vision", NiceVision, a prospect by Nice Systems Ltd., pp. 1-8. Jan. 2002.
Suppelementary European Search Report of European Application No. EP 05 71 8941 dated Mar. 27, 2009.

* cited by examiner

APPARATUS AND METHODS FOR THE SEMI-AUTOMATIC TRACKING AND EXAMINING OF AN OBJECT OR AN EVENT IN A MONITORED SITE

CROSS-REFERENCE TO RELATED APPLICATIONS

The present invention is a national stage application of PCT application number PCT/IL2005/000368 titled APPARATUS AND METHODS FOR THE SEMI-AUTOMATIC TRACKING AND EXAMINING OF AN OBJECT OR AN EVENT IN A MONITORED SITE, filed Apr. 3, 2005, which is incorporated herein by reference.

BACKGROUND OF THE INVENTION

1. Field of the Invention

The present invention relates to video surveillance systems in general, and to an apparatus and method for the semi-automatic examination of the history of a suspicious object, in particular.

2. Discussion of the Related Art

Video surveillance is commonly recognized as a critical security tool. Human operators provide the key for detecting security breaches by watching surveillance screens and facilitating immediate response. For many transportation sites like airports, subways and highways, as well as for other facilities like large corporate buildings, financial institutes, correctional facilities and casinos, where security and control plays a major role, video surveillance systems implemented by Close Circuit TV (CCTV) and Internet Protocol (IP) cameras are a major and critical tool. A typical site can have one or more and in some cases tens, hundreds and even thousands of cameras spread around, connected to the control room for monitoring and at times also for recording. The number of monitors in the control room is usually much smaller than the number of cameras on site, while the number of human eyes watching such monitors is smaller yet.

The human operator's tiring and boring job of watching multiple cameras on split screens, when most of the time nothing happens is facilitated by existing techniques. These techniques include the identification and tracking of distinguishable objects in each of the captured video streams, and marking these objects on the displayed video streams. Objects are identified and tracked at their first appearance in the video stream. For example, when a person carrying a bag walks into a monitored area, an object is created for the person and the bag together. Alternatively an object is identified as such once it is separated from a previously identified object, for example a person walking out of a car, a left luggage and the like. In the former example as soon as the person leaves the car, he is identified as a separate object than the car, which in itself can be defined as an object.

More advanced systems such as NICEVision Content Analysis applications manufactured by NICE Systems, Ltd. Of Ra'anana Israel can further alert the user that a situation which is defined as attention-requiring is taking place. Such situations include intrusion detection, a bag left unattended, a vehicle parked in a restricted area and others. In addition to the generated alert, the system can assist the user in rapidly locating the situation by displaying on the monitor one of the available video streams showing the site of the attention-requiring situation, and emphasize, for example by encircling the problematic object by a colored ellipse.

Alerts are triggered by a variety of circumstances, one or more independent events, or combination of events. For example, alert can be triggered by: a specific event, predetermine time that elapsed from a specific event, an object that passed a predetermined distance, an object that entered to or existed form a predetermined location, predetermined temperature measured, weapon noticed or otherwise sensed, and the like.

In order to avoid alerts overload, the system often generates an alert not immediately following the occurrence of an alert-requiring situation, but only after a predetermined period of time has elapsed and the situation has not been resolved. For example, an unattended luggage might be declared as such if it is left unattended for at least 30 seconds. Therefore, once the operator becomes aware of the attention-requiring situation, some highly valuable time was lost. The person who abandoned the bag or parked the car in a parking-restricted zone might be out of the area captured by the relevant camera by the time the operator has discovered the abandoned bag, or the like. The operator can of course playback the relevant stream, but this will consume more, and potentially a lot more valuable time and will not assist in finding the current location and route followed by of the required object, such as the person who abandoned the bag, prior to and following the abandonment.

An investigation is not necessarily held in response to an alert situation as recognized by the system. An operator of a monitored site can initiate an investigation in response to a situation that was not recognized by the system as alert triggering, or even without any special situation at all, for example for training purposes.

There is therefore a need in the art for a system that will assist the operator in examining the history of situations, and attaining history and current information about objects that might have been involved with the situation.

SUMMARY OF THE PRESENT INVENTION

One aspect of the present invention regards a method for the investigation of one or more objects shown on one or more first displayed video clips captured by a first image capturing device in a monitored site, the method comprising the steps of selecting the object shown on first video clip, the object having a creation time or disappearance time, and displaying a second video clip starting at a pre determined time associated with the creation time of the object within the first video clip or the disappearance time of the object from the first video clip. The second video clip is captured by a second image capturing device. The method further comprising a step of identifying information related to the creation of the object within the first video clip. The method further comprising a step of incorporating the information in multiple frames of the first video clip, in which the at least one object exists. The information comprises the point in time or coordinates at which the object was created within the first video clip. The method further comprising the steps of: recognizing one or more events, based on predetermined parameters, the events involving the object and generating an alarm for the event. The method further comprising a step of constructing a map of the monitored site, the map comprising one or more indications of one or more locations in which image capturing devices are is located. The method further comprising a step of displaying a map of the monitored site, the map comprising one or more indications of one or more locations in which image capturing devices are located. The method further comprising a step of associating the indications with video streams generated by the image capturing devices. The method further comprising a step of indicating on the map the location of an image capturing device, when a clip captured by the image capturing device is displayed. The step of displaying the second video clip further comprises showing the second video clip in forward or backward direction at a predetermined speed. The method further comprising the steps of: defining a first region within the field of view of the first image capturing device; and defining a second region neighboring to the first region, said second region is within a second field of view captured by a second image capturing device. The second video clip is captured by the second image capturing device. The second video clip captured by the second image capturing device is displayed concurrently with displaying the first video clip. The method further comprising the step of displaying the second video clip where the first video clip was displayed, such that the object under investigation is shown on the second video clip. The method further comprising a step of generating one or more combined video clips showing in a continuous manner one or more portions of the first video clip and one or more portions from the second video clip shown to an operator. The method further comprising a step of storing the combined video clip. The predetermined time associated with the creation of the object is a predetermined time prior to the creation of the object. The first or second video clips are displayed in real time or in off-line.

A second aspect of the disclosed invention relates to a method for tracking one or more objects shown on one or more first video clips showing a first field of view, the clip captured by a first image capturing device in a monitored site, the method comprising the steps of: displaying the first video clip, in forward or backward direction, and at a predetermined speed; identifying a first region within the first field of view; selecting a second region neighboring the first region; and displaying a second video clip showing the second region, thereby tracking the object, the clip is displayed in forward or backward direction, and at a predetermined speed. The method further comprising a step of constructing a map of the monitored site, the map comprising one or more indications of one or more locations in which one or more image capturing devices are located. The method further comprising a step of displaying a map of the monitored site, the map comprising one or more indications of one or more locations in which one or more image capturing devices are located. The method further comprising a step of associating the indication with one or more video streams generated by the image capturing devices. The method further comprising a step of indicating on the map the location of an image capturing device, when a clip captured by the image capturing device is displayed. The method further comprising the steps of defining a region within the field of view of the first image capturing device, and defining a second neighboring region to the first region, the second region is within a second field of view captured by a second image capturing device. The second video clip is captured by the second image capturing device. The second video clip captured by the second image capturing device is displayed concurrently with displaying the first video clip. The method further comprising the step of displaying the second video clip where the first video clip was displayed, such that the object under investigation is shown on the second video clip. The method further comprising a step of generating a combined video clip showing in a continuous manner one or more portions of the first video clip and one or more portions from the second video clip shown to the an during an investigation. The method further comprising a step of storing the combined video clip. The first or second video clips are displayed in real time or in off-line.

Yet another aspect of the disclosed invention relates to an apparatus for the investigation of one or more objects shown on one or more displayed video clips captured by one or more image capturing devices in a monitored site, the apparatus comprising an object creation time and coordinates storage component for incorporating information about the objects within multiple frames of the video clip; an investigation options component for presenting an operator with relevant options during the investigation; and an investigation display component for displaying the video clip.

Yet another aspect of the disclosed invention relates to a non-transitory computer readable storage medium containing a set of instructions for a general purpose computer, the set of instructions comprising an object creation time and coordinates storage component for incorporating information about the at least one object within multiple frames of the at least one video clip, an investigation options component for presenting an operator with relevant options during the investigation; and an investigation display component for displaying the at least one video clip.

BRIEF DESCRIPTION OF THE DRAWINGS

The present invention will be understood and appreciated more fully from the following detailed description taken in conjunction with the drawings in which.

DETAILED DESCRIPTION OF THE PREFERRED EMBODIMENT

Definitions

Image capturing device—a camera or other devices capable of capturing sequences of temporally consecutive images of a location, and producing a plurality or a stream of images, such as a video stream. Close Circuit TV or IP cameras or like cameras are examples of image capturing devices that can be used in a typical environment in which the present invention is used. The produced video streams are monitored or recorded. Such devices can also include X-Ray, Infra-red cameras, or the like.

Site—an area defined by geographic boundaries monitored by one or more image capturing devices. A site includes one or more sub-areas that can be captured by one or more image capturing devices. A sub-area may be covered by one or more image acquiring device. A sub area may also be outside the area of coverage of an image capturing device. For example, a site in the context of the present invention can be an airport a train or bus station, a secured area that should not be trespassed, a warehouse, a shop and any other area monitored by an image capturing device.

Field of view (FOV)—a sub-area of a monitored site, entirely captured by an image-capturing device. The FOV or parts thereof can be captured by additional image-capturing devices, but at least one image capturing device fully captures the FOV.

Region—a part of the boundary or a part of the area of a FOV. Example for regions include the northern part of the boundary of a FOV; the northern part of a FOV; a line or a region within the FOV, and the like. A FOV can contain one or more regions.

Figure 1:
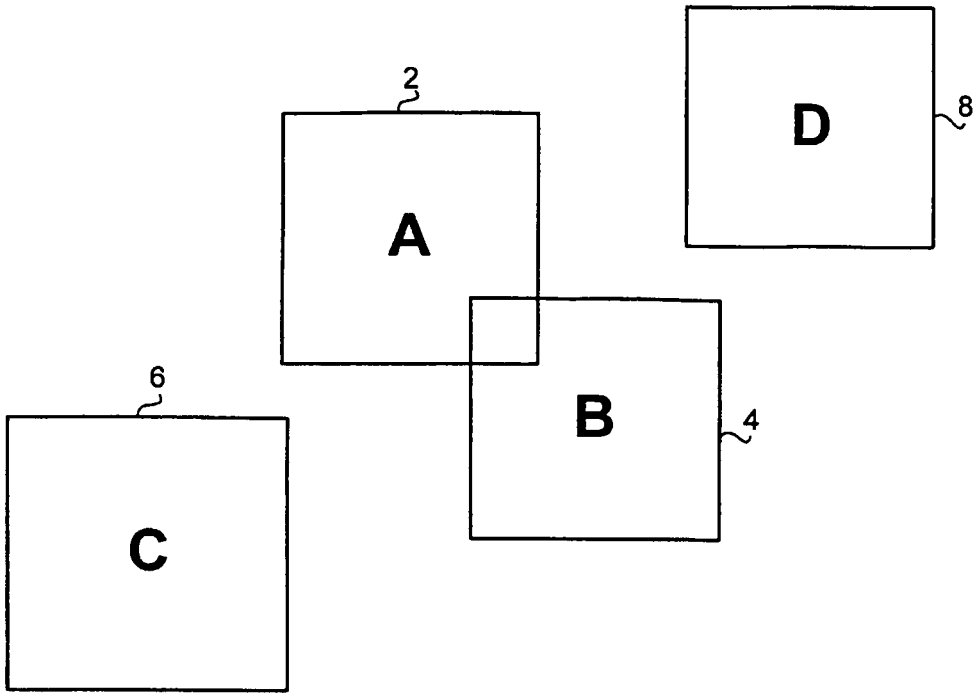
FIGS. 1 and 2 are schematic maps of neighboring and non-neighboring field of views, in accordance with a preferred embodiment of the present invention.
Figure 2:
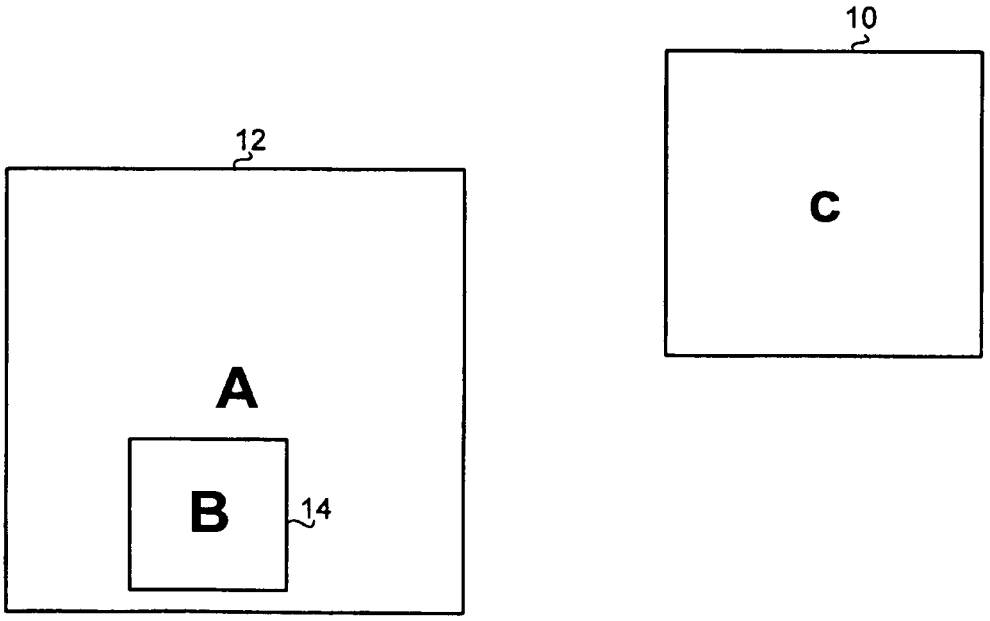

Neighboring fields of view (FOVs)—two FOVs within the site, which may be overlapping, that are defined as neighboring by a user of the apparatus of the present invention. The FOVs may be captured by one or more image capturing devices, and may be overlapping. Referring to FIG. 1 the presented FOVs 2 and 4, are mutually neighboring by definition. However, FOVs C (6) and D (8) are not likely to be declared as such by a user of the apparatus of the invention. Referring now to FIG. 2, FOVs B (14) and C (10) are not neighboring, because an object is not likely to pass from FOV B (14) to FOV C (10) without passing through FOV A (12), or an area between FOVs A (12) and C (10). However, in compliance with the above, such FOVs will be regarded as neighboring if the user chooses to declare them as such. Another example for neighboring FOVs is the elevators areas in all floors of a building. Since a person can walk into and out of an elevator at any floor, all monitored areas bordering the elevators should be mutually declared as neighbors. When declaring FOVs as neighboring, a user can also denote which region or regions of one or two FOVs are neighboring. For example, a first room and a second room internal to the first room can be declared as neighbors, where the neighboring regions of both rooms are the areas adjacent to the door of the internal room, from both sides.

Video clip—a part of a video stream, having a start time or an end time, taken by an image-capturing device monitoring an FOV, played in a forward or backward direction, in a predetermined speed.

Object—a distinguishable entity in a monitored FOV, which does not belong to the background of the environment. Objects can be vehicles, persons, pieces of luggage, and any other like object which may be monitored and is not a part of the background of the environment monitored. In the context of the present invention, the same entity as captured in two or more video clips is considered to be different objects.

Map—a computerized schematic plan or diagram or illustration of the site, comprising indications for the locations of the image-capturing devices capturing FOVs in the site.

An apparatus and method to assist in the examination of the history of situations in a monitored site, and monitoring the development of situations is disclosed. The apparatus also locates objects, i.e. enables the identification and tracking of objects within the monitored scene. The apparatus and method can be employed in real time or in off line environments. Usage of the proposed apparatus and method eliminate the need for precious-time-consuming and unhelpful playbacks of video clips. The proposed apparatus and method utilize information incorporated in multiple frames of the stream itself, thus eliminating the need for retrieving information from a database, which is a lengthy and resource-consuming operation. The information can be stored in each frame of the stream or in a predetermined number of frames of the stream, such as in every second frame, or in every predetermined frames of the stream, or in any like combination. However, the system can store the information in a database, in addition or instead of storing it in the stream. The system identifies and tracks objects, such as people, luggage, vehicles and other objects showing in one or more frames within a stream. The system can also recognize events as attention-requiring, due to predetermined interactions between the objects recognized within the stream or other conditions. The system stores within each frame of the stream the creation time and location of each object present on the frame, i.e., the time when the object has first been recognized within the stream, and the coordinates of the object within the frame in which the object was first recognized. While the present invention can be applied to any stream of images captured by an image capturing device, the present invention will be better explained and illustrated by referring to video images captured by video cameras.

When using the proposed system, a setup stage is held prior to the ongoing operation. During the setup stage a map of the site is created, and the locations of the image capturing devices are marked on the map and linked to the streams generated by the corresponding image capturing devices. An additional stage in the setup of the environment is a definition of one or more regions within each captured FOV, and the definition of which regions of which FOVs are neighboring any other regions or FOVs. Each region or FOV can be assigned zero, one or multiple neighbors.

When the apparatus is used in an ongoing manner, an alert is generated for an attention-requiring situation. The alert contains indication for one or more objects for which the attention of the operator is required, and optionally triggers the system to display a stream depicting the FOV in which the situation occurs and possibly neighboring FOVs. Once the operator is notified about the suspicious objects, or even when no alert has been detected, and therefore no object is suspicious, the operator can initiate the process of investigation of the history of one or more objects. The operator selects a suspect object, or any other identified object and requests to view a clip starting at a time associated with the creation time of the relevant object. The associated time can be relative, i.e., a predetermined time prior or subsequent to the creation of the object, or absolute, i.e., a certain time of a certain date. Since the creation time of each object is stored within any video frame in which the object is identified, the time is immediately available, and the operator does not have to play the video backwards to examine where or how the object entered the FOV captured by the image acquiring device. Preferably, the video clip is presented in a central location on a display, such as a television or a computer screen. Throughout the presentation of the video clip, one or more video clips of neighboring FOVs are presented on one or more additional locations on the display showing the relevant locations at concurrent or other predetermined time frames. The second locations can be smaller or the same size displays, such as different or additional windows opened on the device displaying the video clip, such as on a single computer screen or a single television screen having the capability to show more than one video clip at a time. Alternatively, the second locations can be shown on multiple displays positioned adjacent one to the other, or situated in any other presentation manner. In a preferred embodiment of the present invention, a map of the site is presented as well, with the location of the image-capturing device whose clip is currently presented in the central display highlighted, so the operator has immediate understanding of the actual location in the site of the situation he or she are watching.

In another preferred embodiment of the present invention, the operator of the apparatus of the present invention focuses on an object of interest—the first object. The first object is identified by the system when entering a first FOV captured by the video stream. To identify the origin of the first object the operator can replay the last several seconds or any predetermined time of the video stream of a neighboring FOV, starting from the time the object is identified in the first video clip and going backwards in time, to identify the location and the region of the FOV through which the first object possibly entered the first FOV, if such region has been defined for the FOV. Once the video clip of the neighboring FOV is replayed, a second object is visually identified by the operator as being the first object in the first FOV, although the first object is not logically linked within the apparatus of the present invention to the second object on the second video clip. The operator can then click on the second object in the neighboring FOV (or second video clip) and request to associate the first object that appeared in the first sub—are with the second object that appeared in the neighboring (second) FOV. The operator may also request to present the video of this neighboring FOV starting at the time the second object entered into the neighboring FOV. Repeating these actions, the operator can track the first object back until the time the object was first recognized in the site. For example, if the site is a fully monitored airport, and the suspicious object is a person, the person can be tracked back to the car with which he entered the airport. If the suspicious object has been first identified in the stream when it forked from another object (such as an abandoned luggage), the operator can view the creation of the object, in this case the time the owner of the luggage abandoned it, and then keep tracking the owner of the abandoned luggage. At any given time, the operator can choose to play the clip containing a chosen object in a regular speed, i.e., in the same rate at which the frames of the clip were captured, or at any predetermined speed faster or slower than the capturing speed. The operator can also choose to play the clip in a forward or backward direction. In the example of the abandoned luggage, playing fast the video clip in the forward direction, shows the owner of the luggage will facilitate additional replays allowing "following" such person through associating the object associated with such person through a number of video clips shown to the operator and ultimately tracking such person's current location and allowing security personnel to further investigate the reasons associated with the unattended luggage in expeditious manner. Thus, the incorporation of the creation time of every object within any frame in which it is present, enables the rapid and efficient investigation of the history of an object or an event. In addition, through associating one object with another, such as associating the first object and the second object detailed above, an association list of objects is created. The association list of object enables a quick investigation and examination of the history of an object. Moreover, a supervisor or another operator of the apparatus of the present invention may request to query the origin or the route of an object which was previously associated with other objects in other video clips and receive a temporal sequenced video clips wherein the object is seen. The operator may play the video clips forward or backward, align the display in a geographical oriented manner or in any other orientation, include such orientation showing the gaps, if such exist, between the imaging acquiring devices, on a single or a plurality of displays. In a preferred embodiment of the present invention, while a video clip showing a first FOV is presented, video clips depicting FOVs which were defined as neighbors of the first FOV are presented as well, possibly in smaller size or lesser detail. If here is an highlighted object in the first clip, and the highlighted object is leaving the FOV through a region having a known neighboring FOV, the system can automatically start showing a clip depicting the neighboring FOV instead of the first clip, and show the neighbors of the second FOV as well. The locations where the neighboring clips are presented can be further configured to display the relevant FOVs at predetermined time prior to the time the first clip is presenting.

Figure 3:
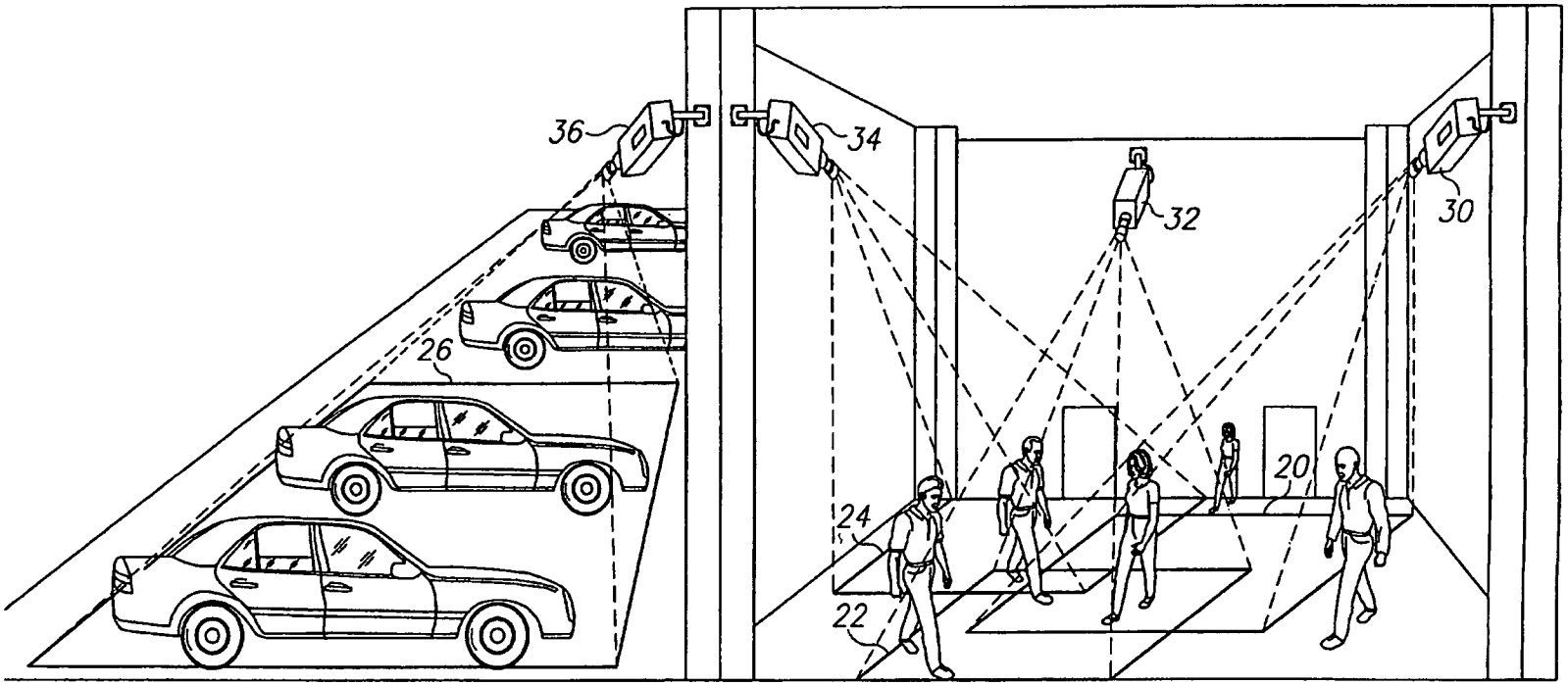
FIG. 3 shows a schematic drawing of a monitored site, in accordance with a preferred embodiment of the present invention.

Referring now to FIG. 3 that shows an exemplary environment in which the proposed apparatus and associated method are used. In the present non-limiting example, the environment is a security-wise sensitive location, such as a bank, an airport, a train or bus station, a public building, a secured building or location, or the like, that is monitored by a multi-image acquiring devices system. The video cameras 30, 32 and 34, capture respectively the FOVs 20, 22 and 24 of a public area within a sensitive location. The FOVs 20, 22 and 24 are partially overlapping and are likely to be defined as neighboring by an operator or supervisor of the system. Camera 36 captures a FOV in the parking lot 26. FOV 26 is not geometrically neighboring any of the FOVs 20, 22 and 24. However, if people are likely to pass from the parking lot to the public area of the sensitive location without being captured by another video camera, then FOV 26 is likely to be defined as neighboring FOVs 20, 22 and 24.

Figure 4:
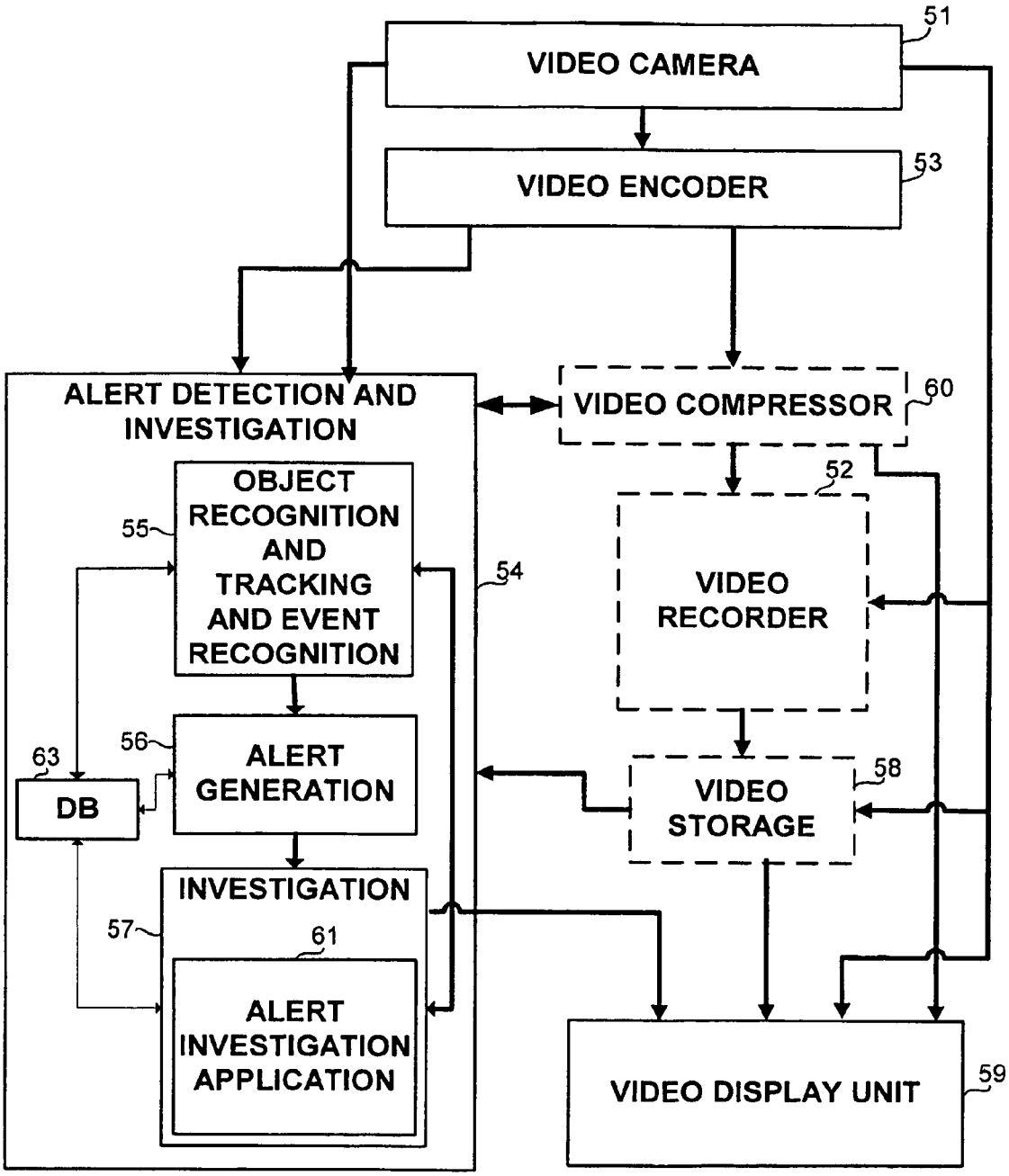
FIG. 4 is a schematic block diagram of the proposed apparatus, in accordance with a preferred embodiment of the present invention.

Referring now to FIG. 4 that shows an exemplary structure in which the proposed apparatus and associated method is implemented and operated. In the framework of this exemplary surveillance system, the location includes a video camera 51, a video encoder 53, and an alert detection and investigation device 54. Persons skilled in the art will appreciate that environments having a single or any other number of cameras can be used in association with the teaching of the present invention in the manner described below. Optionally, the environment includes one or more of the following: a video compressor device 60, a video recorder device 52, and a video storage device 58. The video camera 51 is an image-acquiring device, capturing sequences of temporally consecutive images of the environment. Each image captured includes a timestamp identifying the time of capture. The camera 51 relays the sequence of captured frames to a video encoder unit 53. The unit 53 includes a video codec. The device 53 is encodes the visual images into a set of digital signals. The signals are optionally transferred to a video compressor 60, that compresses the digital signals in accordance with now known or later developed compression protocols, such as H261, H263, MPEG1, MPEG2, MPEG4, or the like, into a compressed video stream. The encoder 53 and compressor 60 can be integral parts of the camera 51 or external to the camera 51. The codec device 53 or the compressor device 60, if present, transmits the encoded and optionally compressed video stream to the video display unit 59. The unit 59 is preferably a video monitor. The unit 59 utilizes a video codec installed therein that decompresses and decodes the video frames. Optionally, in a parallel manner, the codec device 53 or the compressor device 60 transmit the encoded and compressed video frames to a video recorder device 52. Optionally, the recorder device 52 stores the video frames into a video storage unit 58 for subsequent retrieval and replay. If the video frames are stored an additional timestamp is added to each video frame detailing the time such frame was stored. The storage unit 58 can be a magnetic tape, a magnetic disc, an optical disc, a laser disc, a mass-storage device, or the like. In parallel to the transmission of the encoded and compressed video frames to the video display unit 59 and the video recorder device 52, the codec device 53 or the compressor unit 60 further relays the video frames to the alert detection and investigation device 54. Optionally, the alert detection and investigation device 54 can obtain the video stream from the video storage device 58 or from any other source, such as a remote source, a remote or local network, a satellite, a floppy disc, a removable device, and the like. The alert detection and investigation device 54 is preferably a computing platform, such as a personal computer, a mainframe computer, or any other type of computing platform that is provisioned with a memory device (not shown), a CPU or microprocessor device, and several I/O ports (not shown). Alternatively, the device 54 can be a DSP chip, an ASIC device storing the commands and data necessary to execute the methods of the present invention, or the like. The alert detection and investigation device 54 comprises a setup and definitions component 50. The setup and definitions component 50 facilitates creating a map of the site and associating the locations of the image capturing devices on the map with the streams generated by the relevant devices. The setup and definitions component 50 further comprises a component for defining FOVs or regions of FOVs as neighboring. The alert detection and investigation device 54 further comprises an object recognition and tracking and event recognition component 55, an alert generation component 56, and an alert investigation component 57. The alert investigation component 57 further contains an alert preparation and investigation application 61. The alert investigation application 61 is a set of logically inter-related computer programs and associated data structures operating within the investigation device 54. In the preferred embodiments of the present invention, the alert investigation application 61 resides on a storage device of the alert detection and investigation device 54. The device 54 loads the alert investigation application 61 from the storage device into the processor memory and executes the investigation application 61. The alert detection and investigation device 54 can further include a storage device (not shown), storing applications for object and event recognition, alert generation, and investigation, the applications being logically inter-related computer programs and associated data structures that interact to provide alert detection and investigation device. The encoded and optionally compressed video frames are received by the device 54 via a pre-defined I/O port and are processed by the applications. The database (DB) 63, is optionally connected to all components of the alert detection and investigation device 54, and stores information such as the map, the neighboring FOVs and regions, the objects identified in the video stream, their geometry, their creation time and coordinates, and the like. Alternatively, some of the components can store information within the video stream and not in the database. Note should be taken that although the drawing under discussion shows a single video camera, and a set of single devices, it would be readily perceived that in a realistic environment a multitude of cameras could send a plurality of video streams to a plurality of video display units, video recorders, and alert detection and investigation devices. In such environment there can optionally be a central control unit (not shown) that controls the overall operation of the various components of the present invention.

Further note should be taken that the apparatus presented is exemplary only. In other preferred embodiments of the present invention, the applications, the video storage, video recorder device or the abnormal motion alert device could be co-located on the same computing platform. In yet further embodiments of the present invention, a multiplexing device could be added in order to multiplex several video streams from several cameras into a single multiplexed video stream. The alert detection and investigation device 54 could optionally include a de-multiplexer unit in order to separate the combined video stream prior to processing the same.

The object recognition and tracking and event recognition component 55 and the alert generation component 56 can be one or more computer applications or one or more parts of one or more applications, such as the relevant features of NICE Vision, manufactured by NICE of Ra'anana Israel described in detail in PCT application Ser. No. PCT/IL03/00097 titled METHOD AND APPARATUS FOR VIDEO FRAME SEQUENCE-BASED OBJECT TRACKING, filed 6 Feb. 2003, and in PCT application Ser. No. PCT/IL02/01042 titled SYSTEM AND METHOD FOR VIDEO CONTENT-ANALYSIS-BASED DETECTION, SURVEILLANCE, AND ALARM MANAGEMENT, filed 26 Dec. 2002 which are incorporated herein by reference. The object recognition and tracking and event recognition component 55 identifies distinct objects in video frames, and tracks them between subsequent frames. An object is created when it is first recognized as a distinct entity by the system. Another aspect of this module relates to recognizing events involving one or more objects as requiring attention form an operator, such as abandoned luggage, parking in a restricted zone and the like. The alert generation component 56 is responsible for generating an alert for an event that was recognized as requiring attention from an operator. In the context of the proposed invention, the generated alert comprises any kind of drawing attention to the situation, be it an audio indication, a visual indication, a message to be sent to a predetermined person or system, or an instruction sent to a system for performing a step associated with said alarm. In a preferred embodiment of the disclosed invention, the generated alert includes visually highlighting on the display unit 59 one or more objects involved in the event, as recognized by the object and event recognition component 55. The alert indication prompts the operator to initiate an investigation of the event, using the investigation component 57.

Figure 5:
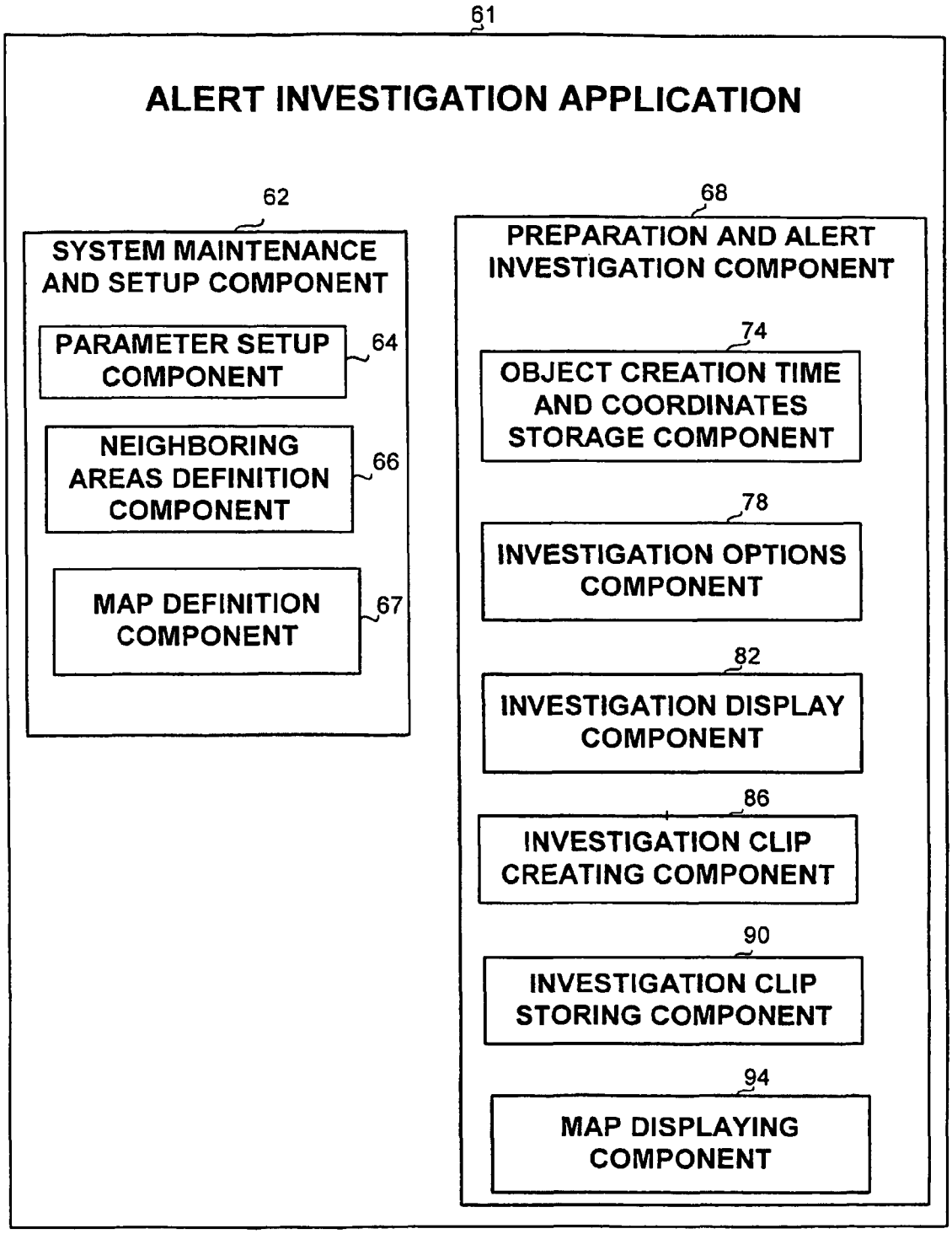
FIG. 5 is a block diagram showing the main components of the alert investigation application, in accordance with a preferred embodiment of the present invention.

Referring now to FIG. 5, showing the main components of the alert investigation application, in accordance with a preferred embodiment of the present invention. The alert investigation application 61 is a set of logically inter-related computer programs and associated data structures operating within the devices shown in association with FIG. 4. Application 61 includes a system maintenance and setup component 62 and an alert preparation and investigation component 68. The system maintenance and setup module 62 comprises a parameter setup component 64 which is utilized for setting up of the parameters of the system, such as pre-defined threshold values and the like. The system maintenance and setup module 62 comprises also a neighboring FOVs definition component 66. Using the neighboring FOVs definition component 66, the operator or a supervisor of the site defines regions of FOVs, and neighboring relationships between FOVs or regions of FOVs captured by the various video cameras. The process of defining the neighboring relationships between FOVs or regions of FOVs is preferably carried out in a visual manner by the operator. The operator uses a point and click device such as a mouse to choose for each FOV or region of FOV, those FOVs or regions of FOVs that neighbor it. Thus, the operator can define the way he or she prefers to see the display, i.e., when a certain FOV is displayed, which FOVs are to be displayed concurrently, and in which layout. The operator is likely to position the various displays of the FOVs in a geographically oriented manner so as to allow him to make the visual connection between objects moving from the first FOV to other FOVs. Alternatively, the definition is performed via a command prompt software program, a plain text file, an HTML file, or the like. In the map definition component 67, the operator constructs or otherwise integrates a schematic map of the site, with indications for the locations of the image capturing device. In addition, the stream generated by each device is associated with the relevant location on the map. Thus, when a clip of a certain stream is presented, the system automatically highlights the location of the relevant image capturing device, so the operator orients the situation with the actual location.

Still referring to FIG. 5, the alert preparation and investigation component 68, comprises an object creation time and coordinates storage component 74. The object creation time and coordinates storage component 74 receives a video stream and the indication of the objects recognized in the video stream, as recognized by the object and event recognition component 55 of FIG. 4. The object creation time and coordinates storage component 74 incorporates, in addition to the current geometric characteristics of the object, also information about the creation time and creation coordinates of the object, i.e. the time associated with the video frame in which the object was first recognized in the video stream, and the coordinates in that frame where the object was recognized. The relevant timestamp and location are associated with every object recognized in every frame of the video stream, and stored with the frame itself. This timestamp enables the system to immediately start displaying a clip exactly, or a predetermined time prior to when an object was first recognized. The creation coordinates can clarify which region the object entered the FOV through. Since the neighbors of each FOV are known, if there is a single neighbor for that region, it is possible to automatically switch to the clip showing the FOV from which the object arrived into the current FOV.

The recognition of an object within a video stream can be attributed to the entrance of the object into the FOV captured by the video stream, such as when a person walks into the monitored FOV. Alternatively, the object is recognized when it is forked from another object within the monitored FOV, and recognized as an independent object, such as luggage after it has been abandoned by a person that carried the luggage to the point of creation/abandonment. In the later case, the time incorporated in the video stream will be the abandonment time of the luggage, which is the time the luggage was first recognized as an independent object. The alert investigation component 68 comprises also the investigation display component 82. The investigation display component 82 displays one or more video clips where the recognized objects are marked on the display. Preferably, all recognized objects are marked on every displayed frame. Alternatively, according to the operator's preferences, only objects that comply with an operator's preferences are marked. Possibly, one or more marked objects are highlighted on the display, for example, when an alert is issued concerning a specific object, it will be highlighted. However, an object does not have to be highlighted by the system in order to be investigated. The operator can click on any object to make such object highlighted, and evoke the relevant options for the object. In a preferred embodiment of the disclosed invention, a first video clip is displayed in a first location, and one or more second video clips are displayed in second locations.

For example, the operator can choose that the first location would be a primary location and would be a centrally located window on a display unit, while the second locations can be possibly smaller windows located on the peripheral areas of the display. In another preferred embodiment, the first location can be one display unit dedicated to the first video clip and the one or more second video clips are displayed on one or more additional displays. In yet another embodiment, the first video clip is taken from a video stream in which an attention-requiring event had been detected, or simply the operator decided to focus on the relevant FOV. The one or more second video streams depict FOVs previously defined as neighboring to the FOV depicted in the first video stream. In a preferred embodiment, the operator can drag one of the second video clips to the first location, and the system would automatically present on the second locations the FOVs neighboring to the second clip. Preferably, When an highlighted object is leaving the first FOV through a region which is known to be a neighbor of a second FOV, a video clip showing the second FOV can be automatically presented in the first location, and its neighboring FOVs depicted in the secondary locations. Thus, when a highlighted object moves between two neighboring FOVs, the system can automatically change the display and make the FOV previously presented in the first location move to the second location and vice versa. Other changes may occur as well, for example other neighboring FOVs which are presented when the first FOV is displayed at the first location can be replaced with FOVs neighboring the second FOV. In another preferred embodiment of the present invention, a map of the site is presented as well, with a clear mark of the location of the image-capturing device whose clip is currently presented in the central display, so the operator can immediately grasp the actual location in the site of the situation he or she are watching. The investigation component 68 further comprises an investigation options component 78. The investigation options component 78 is responsible for presenting the operator with relevant options at every stage of an investigation, and activating the options chosen by the operator. In a preferred embodiment of the disclosed invention, the options include pointing at an object recognized in a video stream, and choosing to display the clip forward or backward, set the start and the stop time of the clip to be displayed, set the display speed and the like. The options include also the relationship between the clips displayed in the first and in the second locations. For example, the operator can choose that during investigation the second displays will show the associated video clips backwards, starting at a time prior to when the object under question was first identified in the first video stream. This can facilitate rapid investigation of the history of an event. As mentioned above, the operator can choose to display the clip starting at the time when the object was first recognized or created in the stream. Another option can be pointing at an object identified in a video stream and choosing to play the clip in a fast forward mode, until the object is not recognized in the stream anymore (e.g. the person left the FOV), or until the clip displays the FOV at the present time, when fast forward is no longer available. The abovementioned options are available, since the system does not have to access or search through a database for the creation time of an object within a video stream. Since this timestamp is available for every frame, moving backwards and forward through the period in which the object exists in the video stream is immediate. The preparation and alert investigation component 68 further comprises an investigation clip creating component 86. The function of the investigation clip creating component 86 is to generate a continuous clip out of the clips displayed in the first or in a second location during an investigation. The continuous clip depicts the investigation as a whole, without the viewer having to switch between presentation modes, speeds, and directions. Using the investigation clip storing component 90, the generated clip can be stored for later usage, editing with standard video editing tools, and the like. The clip can be later used for purposes such as sharing the investigation with a supervisor, further investigations or presentation to a third party such as the media, a judge, or the like. The preparation and alert investigation component 68 further comprises a map displaying component for displaying a map of the monitored site, and indicating on the map the location of the image capturing device, that captured the clip displayed in the first location.

Figure 6:
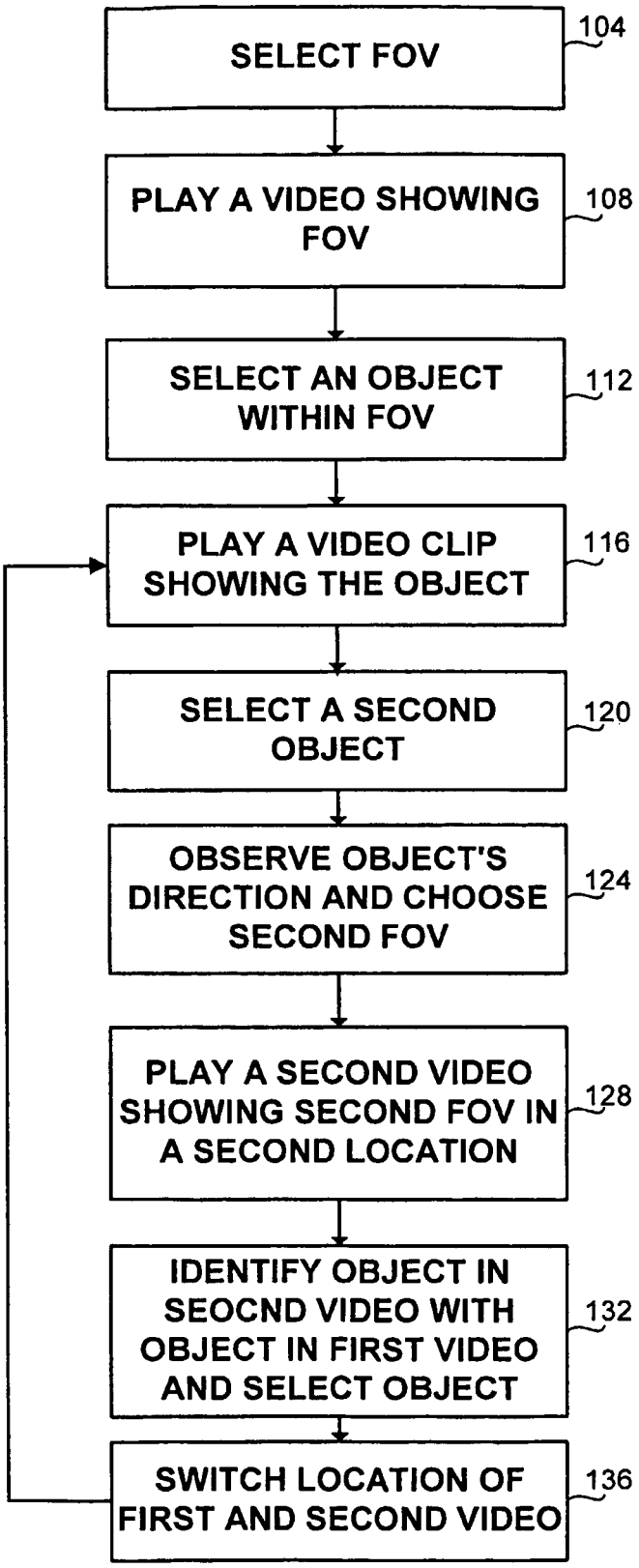
FIG. 6 is a flowchart showing a typical scenario of using the system, in accordance with a preferred embodiment of the present invention.

FIG. 6 presents a flowchart of typical scenario of working with the system. The presented scenario is exemplary only and other processes and scenarios are likely to occur. Due to the exemplary nature of the presented scenario, multiple steps of the scenario can be omitted, repeated, or performed in a different order than shown, and other steps can be performed. In step 104, the operator selects an FOV to focus on. In step 108 the operator plays a video showing the relevant FOV. Alternatively, the system recognizes a situation as requiring attention, and automatically displays the clip of the relevant FOV. In step 112, the operator selects an object within the FOV. In another scenario, the operator might get an alert form the system, in which case the relevant video is displayed and a suspicious object is already selected. This makes steps 104, 108 and 112 redundant. In step 116, the operator plays a video clip depicting the selected object. It is also possible to play a video clip without any particular object being selected. The video clip can be played forward or backward. The video clip can start or end at the present time, or at the creation time of a specific object within the stream, or at a predetermined time. The video clip can also be played in the capturing speed or at any other predetermined speed, faster, or slower. In step 120, the operator possibly selects a second sub-object. For example, if the operator has been tracing an abandoned piece of luggage, he or she can now select the person who abandoned the piece of luggage. In step 124 the operator observes the object of interest and chooses a second FOV from which the object arrived to the relevant FOV or to which he left the present FOV. Alternatively, if a neighboring FOV has been defined for the displayed FOV, or to the region of the FOV in which the person was first identified, the system automatically determines the second FOV. In step 128, the operator or the system plays a second video showing the second FOV. The second video clip is possibly played in a second location, such as a different monitor, a different window on the same monitor or the like. Possibly, the first video is presented in a preferred location relatively to the second video, such as a larger or more centrally located monitor, a larger window, or the like. In step 132, the operator possibly identifies an object in the second clip with the object he or she has been watching in the first clip. The operator can also select a different object in the second video clip. In step 136, the system presents the second video clip on the prime location and the second video clip on one of the secondary locations. Since neighboring is preferably mutual, i.e., if the second FOV neighbors the first FOV, then the first FOV neighbors the second FOV, the first FOV is presented as a neighbor of the second FOV which is now in the primary location. Alternatively, the operator can move, for example by dragging, the second video to the first location and keep watching the video. The process can then be repeated by playing a video clip that relates to the second video and to the object selected in the second video as was explained in step 116. The operator can also abandon the process as shown, and initiate a new process by starting step 104 or step 116 if the system generates another alarm.

For further clarity of how the apparatus can be used in a security-sensitive environment, two exemplary situations are presented.

The first example relates to abandoned luggage. A person carrying a luggage walks into a first FOV captured by a video camera, puts the luggage down, and walks away. After the luggage has been abandoned for a predetermined period of time, the surveillance system generates an alert for unattended luggage, and the luggage is highlighted in the stream produced by the relevant camera. The operator chooses the option of showing the video clip, starting a predetermined time prior to the creation time of the luggage as an independent object, i.e. the abandonment time. Viewing this segment of the clip, the operator can then see the person who abandoned the bag. Now, that the operator knows who the abandoning person is, the operator can then follow the person by fast-forwarding the clip. When the operator observes that the person leaves the FOV depicted by the video stream towards a neighboring FOV, the operator can drag the video clip showing the neighboring FOV to be displayed in the primary location, while the secondary locations are updated with new FOVs, which are neighboring the new FOV displayed in the first location.

The operator preferably continues to follow the person in a fast-forward manner until the current location of the person is discovered, and security can access him. In addition, the operator can track the person backwards to where the person first entered the site, for example the parking lot, and locate his or her car. The operator may also associate between the object (person) in the neighboring FOV to the same object (person) shown in the first FOV by clicking on the object in the neighboring FOV and requesting to associate it with the object in the first FOV. The operator may associate persons with other persons or with cars or other animate objects. In another scenario that same person met with another person. Further investigation can track the other person, and any luggage he may be carrying, as well.

Another example is a vehicle parking in a forbidden location. Once the operator receives an alert regarding the vehicle, he or she can view the video clip starting at the time when the vehicle entered the scene, or at what point in time a person entered or exited said vehicle. Fast forwarding from that time on, will reveal the person who left the vehicle, his behavior at the time (was he alert, suspicious, or the like) and the direction in which he or she went. The person can then be tracked as far as the site is captured by video cameras, and his intentions can be evaluated.

The above shown components, options and examples serve merely to provide a clear understanding of the invention and not to limit the scope of the present invention or the claims appended thereto. Persons skilled in the art will appreciate that other features or options can be used in association with the present invention so as to meet the invention's goals.

The proposed apparatus and methods are innovative in terms of enabling an operator or a supervisor monitoring a security-sensitive environment to investigate in a rapid and efficient manner the history and development of an attention-requiring situation or of an object identified in a video stream. The presented technology uses a predetermined association between FOVs and regions thereof, and the neighboring relationships between FOVs and regions thereof. The disclosed invention enables full object location and tracking within a FOV and between neighboring FOVs, in a fast and efficient manner. The operator has to observe the FOV towards which or from which the object left or entered the current FOV or region thereof, and the switching between presenting video clips showing the relevant FOVs is performed automatically by the system.

The method and apparatus enable the operator to handle and resolve in real-time or near-real-time complex situations, and increase both the safety and the well-being of persons in the environment.

More options for the operator for manipulating the video streams can be employed. For example, the operator can generate a detailed map of the environment, and define the border along which a first FOV and a second FOV are neighboring. Then if a person leaves the first FOV through the defined border, the system can automatically display the video clip of the second FOV in the first location, so the operator can keep watching the person.

Additional components can be used to interface the described apparatus to other systems, It will be appreciated by persons skilled in the art that the present invention is not limited to what has been particularly shown and described hereinabove. Rather the scope of the present invention is defined only by the claims which follow.

What is claimed is:

1. A method for the investigation of an at least one object shown on an at least one first displayed video clip captured by an at least one first image capturing device in a monitored site, the method comprising:

receiving a selection from a human operator of an at least one object in an at least one first video clip, said at least one object having an associated creation time and an associated disappearance time;

automatically displaying, in forward or backward direction or at a predetermined speed, an at least one second video clip with a field of view neighboring a field of view of the first video clip, starting at the predetermined time associated with the associated creation time of the at least one object in the first video clip or the associated disappearance time of the at least one object in the first video clip;

receiving a selection of a second object in said at least one second video clip responsive to an action of the human operator;

receiving from the human operator a manual association of the at least one object with said second object, the association identifying said second object as being the same as the least one object; and based on said association, presenting in sequence the at least one first video clip and the at least one second video clip.

2. The method of claim 1 wherein the at least one second video clip is captured by a second image capturing device.

3. The method of claim 1 wherein the at least one frame of the at least one first video clip comprises multiple frames of the at least one first video clip, in which the at least one object exists.

4. The method of claim 1 wherein the information comprises the point in time or coordinates at which the at least one object was created within the at least one first video clip.

5. The method of claim 1 further comprising the steps of:

recognizing an at least one event, based on predetermined parameters, the event involving the at least one object; and generating an alarm for the at least one event.

6. The method of claim 1 further comprising a step of constructing a map of said monitored site, said map comprising at least one indication of an at least one location in which an at least one image capturing device is located.

7. The method of claim 1 further comprising a step of displaying a map of said monitored site, said map comprising at least one indication of an at least one location in which an at least one image capturing device is located.

8. The method of claim 6 further comprising a step of associating said at least one indication with an at least one video stream generated by the at least one image capturing device.

9. The method of claim 7 further comprising a step of indicating on the map the location of an image capturing device, when a clip captured by the image capturing device is displayed.

10. The method of claim 1 further comprising the steps of:

defining at least one first region within the field of view of the at least one first image capturing device; and defining at least one second region neighboring to the at least one first region, said second region is within an at least one second field of view captured by an at least one second image capturing device.

11. The method of claim 10 wherein the at least one second video clip is captured by the at least one second image capturing device.

12. The method of claim 11 wherein the at least one second video clip captured by the at least one second image capturing device is displayed concurrently with displaying the first video clip.

13. The method of claim 1 further comprising the step of displaying the at least one second video clip where the at least one first video clip was displayed, such that the at least one object under investigation is shown on the at least one second video clip.

14. The method of claim 1 further comprising a step of generating an at least one combined video clip showing in a continuous manner at least one portion of the at least one first video clip and at least one portion from the at least one second video clip shown to the human operator.

15. The method of claim 14 further comprising a step of storing the at least one combined video clip.

16. The method of claim 1 wherein the predetermined time associated with the creation of the at least one object is a predetermined time prior to the creation of the at least one object.

17. The method of claim 1 wherein the at least one first or second video clips are displayed in real time.

18. The method of claim 1 wherein the at least one first or second video clips are displayed offline.

19. A method for the investigation of an at least one object shown on an at least one first displayed video clip captured by an at least one first image capturing device in a monitored site, the method comprising:

receiving a selection from a human operator of an at least one object in an at least one first video clip, said at least one object having an associated creation time and an associated disappearance time;

automatically displaying, in forward or backward direction or at a predetermined speed, an at least one second video clip with a field of view neighboring a field of view of the first video clip, starting at the predetermined time associated with the associated creation time of the at least one object in the first video clip or the associated disappearance time of the at least one object in the first video clip;

receiving a selection of a second object in said at least one second video clip responsive to an action of the human operator;

receiving from the human operator a manual association of the at least one object with said second object, the association identifying said second object as being the same as the least one object;

based on said association, presenting in sequence the at least one first video clip and the least one second video clip;

further recognizing an at least one event, based on predetermined parameters, the event involving the at least one object; and generating an alarm for the at least one event.

* * * * *